United States Patent [19]

Veach

[11] 4,232,448

[45] Nov. 11, 1980

[54] BROKEN LINE DRAFTING TEMPLATES

[76] Inventor: Carlos W. Veach, 8921 Ashcroft Ave., Los Angeles, Calif. 90048

[21] Appl. No.: 28,077

[22] Filed: Apr. 9, 1979

[51] Int. Cl.[3] ..... B43L 13/20

[52] U.S. Cl. ..... 33/174 B

[58] Field of Search ..... 33/174 B, 174 G

[56] References Cited

U.S. PATENT DOCUMENTS

| | | | |
|---|---|---|---|
| D. 167,043 | 6/1952 | Kintz | 33/174 B |
| 965,945 | 8/1910 | Roman | 33/174 B |
| 1,534,396 | 4/1925 | Kimura | 33/174 B |
| 1,583,138 | 5/1926 | Garnett | 33/174 B |
| 1,979,724 | 11/1934 | Asencio | 33/174 B |

*Primary Examiner*—Willis Little

*Attorney, Agent, or Firm*—Victor C. Muller

[57] ABSTRACT

Drafting template adapted to be juxtaposed on a drawing sheet characterized by a plurality of like spaced lands, in a grid or comb configuration, across which a marking implement may be moved, forming marks on the drawing between the lands and leaving voids or spaces therebeneath. Templates for straight and circular broken lines and broken lines of other curvatures are disclosed.

1 Claim, 9 Drawing Figures

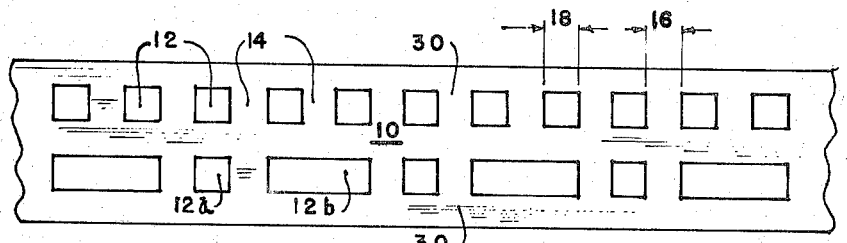
FIG 1
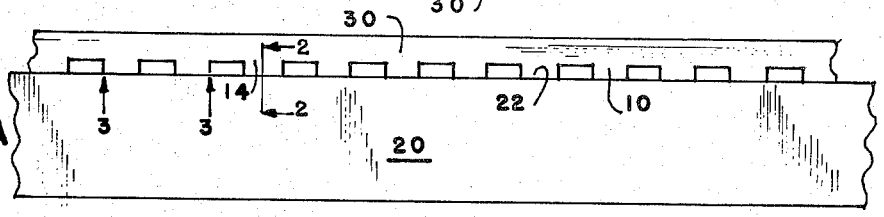
FIG 1A
FIG 1B
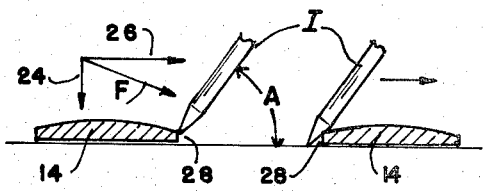
FIG 3
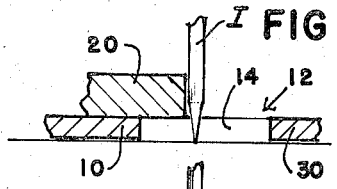
FIG 2
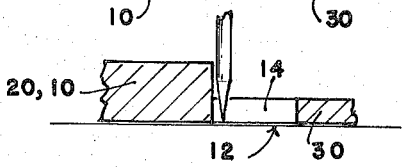
FIG 2A
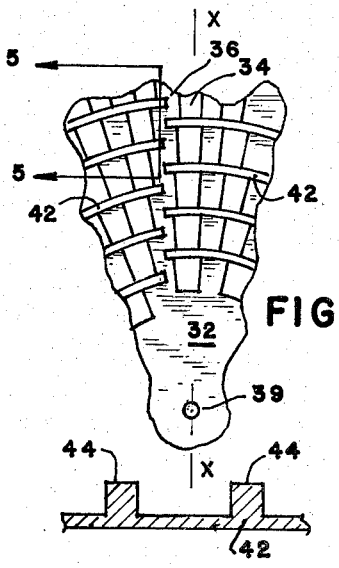
FIG 4
FIG 5
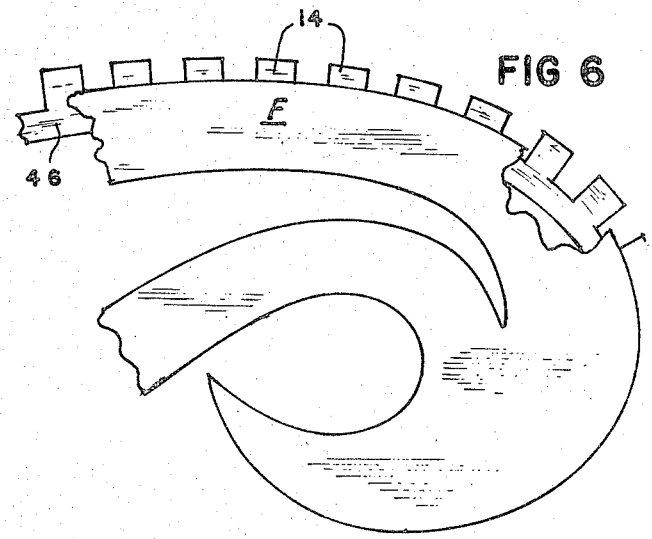
FIG 6

BROKEN LINE DRAFTING TEMPLATES

SUMMARY OF THE INVENTION

Drafting template for drawing broken lines, such as dashes of repetitively equal or unequal length, characterized by a flat template having spaced lands forming spaces therebetween and across which a marking implement such as a pen or pencil, may be moved by an operator. As the implement is moved across the lands it oscillates between the planes of the opposite faces of the template, forming spaced dash marks on the paper.

In one embodiment, the broken line is straight and in another it is circular. In the circular embodiment it is formed as a two part grid to draw lines of all radii within its range. In a further embodiment, curved broken lines other than straight or circular may be drawn.

It is employed in combination with a straight edge, compass, or other drafting instrument used by a draftsman for their other normal purposes.

Consonant with the foregoing, an object of the invention is to provide a template with spaced lands across which a marking implement may be moved for oscillating same toward and away from a drawing to thereby produce a broken line thereon;

Another object is to draw broken lines of differing forms, such as uniformly spaced dashes of equal length or dashes of unequal length, such as center lines;

Another object is to vary the width of the lands and spacings therebetween to thereby vary the arrangement of the dashes produced thereby;

Another object is to provide a template for drawing straight broken lines;

Another object is to provide another template for drawing circular broken lines;

Another object, consonent with the preceding object, is to provide a template for drawing circular broken lines of all radii within its range;

A further object is to provide another template for drawing broken lines of changing curvature;

Still further objects, advantages, and salient features will become more apparent from the detailed description to follow, the appended claims, and the accompanying drawing to now be briefly described.

BRIEF DESCRIPTION OF THE DRAWING

FIG. 1 is a plan of one form of the subject of the invention for drawing straight broken lines;

FIG. 1A is a like view with a straight edge superimposed thereon;

FIG. 1B is a broken line which has been drawn with the combination of parts of FIG. 1A;

FIG. 2 is an enlarged section taken on line 2—2, FIG. 1A, with a marking implement added;

FIG. 2A is a modification of FIG. 2;

FIG. 3 is an enlarged alternative section taken on line 3—3, FIG. 1A, with a drawing implement added;

FIG. 4 is a plan of another form of the invention for drawing circular broken lines;

FIG. 5 is an enlarged section taken on line 5—5, FIG. 4; and

FIG. 6 illustrates a further form of the invention for drawing broken lines other than straight or circular.

DETAILED DESCRIPTION OF PREFERRED EMBODIMENTS

Referring now to the drawing in detail, and first to FIGS. 1 and 2, which illustrate an embodiment for drawing straight broken lines, member 10, formed as a thin sheet of transparent material is provided adjacent one edge thereof with a plurality of like apertures 12 extending therethrough leaving lands 14 therebetween. As illustrated, the length 16 of each land is slightly less than the length 18 of an aperture, the reason for which will subsequently appear. With this construction the spaces between dashes are equal to the lengths of the dashes.

In the operation of this embodiment, as best shown in FIGS. 1A, 2 and 3, template 10 is disposed on a paper sheet in a desired fixed position and a straight edge 20 is fixedly disposed on top of same with an edge 22 thereof crossing the lands along a line entermediate their inner and outer ends. The tip of an implement I, such as a pencil or ruling pen, is maintained in contact with the straight edge in a substantially vertical plane (FIG. 2), and normally at an angle A therein relative to the paper (FIG. 3), and an angular force F applied thereto. As will be apparent, component of force 24 urges it toward the paper and component 26 urges it parallel with the paper, moving it linearly across the lands and spaces therebetween. As the top of the implement moves across an edge 28 of a land it makes a slight free jump into contact with the paper, starting a dash and continues drawing same until it contacts an edge 28 of the adjacent land. This edge then serves as a cam to move the instrument along its axis and away from the paper until it again moves along the top surface of such land. Since the rate of movement of the implement is about the same as would occur in drawing a conventional unbroken line, it is subjected to rapid oscillations toward and from the paper along the direction of the implement axis. FIG. 1B illustrates the broken line generated as above described.

It will be apparent from FIG. 3 that the length of a dash is slightly less than the width of an aperture within which it is drawn due to the free jump and angular direction of exit of the tip of the instrument. It will also be apparent, however, that the relative widths of the apertures and lands may be selected, as desired, to produce dashes and spaces therebetween of any desired relative lengths.

FIG. 1 also illustrates another arrangement of lands and apertures adjacent its other edge for drawing broken lines having repetitive pairs of dashes of differing lengths, typical of which are center lines. As will be apparent, apertures 12*a*, 12*b* are of differing widths to thereby draw repetitive relatively short and long dashes. Also, the spaces between dashes may be selected as desired by varying the widths of the lands.

While not illustrated, it will now become apparent that by proper choice of the widths of the lands and widths of the spaces therebetween, more than two dashes of differing lengths may be drawn and the lengths of the spaces therebetween varied in like manner. Such dashed lines, together with legends which define same, may be desired on occasion by a draftsman to designate certain specialized planes, sections, or the like.

The term "apertures" as so far employed when considered in the light of the drawing, may suggest a surrounded space. It is to be noted that the template material 30 outwardly of the apertures and lands of FIG. 1 is redundant insofar as serving as a guide for an implement. Its principal purpose is to structurally retain the lands in fixed relation and serves also, to protect same against damage due to rough handling. It will therefore be apparent that if the lands are constructed sufficiently rigid this connecting strip 30 may be omitted in which case the lands become spaced projections forming a comb-like construction, that is, the apertures or spaces between lands are open at their outer ends as illustrated in FIG. 6, rather than closed, as illustrated in FIGS. 1–5.

In the construction so far described, template 10 may be formed of thin sheet material and apertures 12 formed by punching. Preferably, the thickness should be a minimum consistent with strength requirements. FIG. 3 illustrates an alternative form which may be constructed by moulding process wherein the tops of lands 14 are convex, thus permitting edges 28 to be disposed close to the drawing paper and minimizing the free jump of implement I, as previously described. With this construction, lands 14 may be considerably thicker, adding strength thereto, and still permitting the implement to smoothly move off of an edge 28 and to cam onto the next edge.

Referring now to FIG. 4, the embodiment for drawing circular broken lines, template 32 may again be formed of thin sheet material, preferably transparent, and provided with radially spaced concentric rows of spaced rectangular apertures 34 and lands 36. As illustrated, two sets of apertures are provided, one set for the right side of axis x—x and another for the left side. The apertures in each set thus extend around center 39 and each set permits drawing a circular broken line of 180° angular extent. If a 360° line is desired, the template is rotated 180° about the center and the line continued for the other 180°. As will be apparent, lines cannot be drawn on any radius which divides one circular row of apertures from the adjacent concentric row, that is, beneath a circular rim 42. Since this would be a serious impairment to the use of the device, the apertures on the left side are arranged at differing radii than those on the right. Thus, the average radius of a left row is the radius of the circular dividing rim 42 of the right row. With this overlapped or staggered construction, circles of any radius, within the range of the template, may be drawn by selecting the appropriate 180° sector thereof.

While not shown, it will be apparent that the template of FIG. 4 could be formed as two separate templates, one with apertures of radii as disclosed on the right side, but extending throughout 360°, rather than 180°, and the other with radii as disclosed on the left side and similarly extending throughout 360°. By utilizing only one half of each of such templates and combining same into a single template, as illustrated, circles of all radii may be drawn by manipulation of the template, as described, which thus reduces the cost to the user to one half of that for two separate templates.

The operation of the arcute broken line template is essentially the same as previously described, the principal difference being that the marking implement is on one leg of a compass and restrained to move in a circular arc, by its other leg, thus obviating the need for the superimposed guiding edge employed with the straight line embodiment. Also, to maintain the angle of the marking end less than 90° (Angle A) to the paper, as illustrated with the straight line embodiment, the upper end of the compass is preferably moved around the base of a cone, the axis of which passes through the lower fixed end of the compass restraining leg.

As illustrated, the construction of FIG. 4 enables drawing equally spaced circular dashes of equal length, like those of one side of the FIG. 1 construction. As will be apparent, however, the lands may be unequally spaced, as disclosed at the other side of FIG. 1 to draw repetitive dashes of unequal length, or otherwise, as described.

In FIG. 4, as so far described, the template has been considered as a thin sheet of transparent material, like that of FIG. 1, with the apertures formed therein by punching out the aperture portions. As disclosed, however, and as best illustrated in FIG. 5, the concentric lands 42 between the rows of apertures are formed with upstanding ribs 44. These provide proper gating for flow of material, such as a thermoplastic, during a moulding process and also stiffen the template so that ejection pins engaging the ribbed side may remove the template from the mould. Also, any marks left by the ejector pins are on unobjectionable parts of the injection moulding. Typical dimensions are 0.010″ maximum thickness for the lands and 0.050″ for the ribs extending thereabove.

The construction of FIG. 1 may also be moulded from thermoplastic material as illustrated in FIG. 2A wherein straightedge 20 is formed as an integral part of member 10. When moulded, the lands may be slightly convexed, as shown in FIG. 3, with a thickness at edges 28 of about 0.004″.

As so far described, by way of example, the templates enable a draftsman to draw broken lines which are either straight or of circular arcuate configuration. Such lines are extensively employed but on some occasions it is desired that they follow various curves, such as French curves or the like. It will now be apparent that both examples are within a concept of arranging a plurality of spaced lands along a desired curve. It thus follows that if lines other than straight or circular are desired, the lands may be arranged along such curve.

As an example, with reference to FIG. 6, the lands 14 may project from one edge of a malleable support member 46 which may be bent to conform to a desired curve which thus disposes the lands above and crossing same. A French curve F may then be superimposed thereon and the broken line drawn as previously described.

What I claim is:

1. Apparatus for drawing a broken line consisting of dashes with spaces therebetween, with a compass carrying a marking end, such as a pencil or pen, on a surface, such as a sheet of paper, comprising:

(a) a support member adapted to be fixedly disposed on said surface, (b) concentric circular rows of relatively thin lands projecting from the support member forming spaces therebetween for exposing the surface therebelow, (c) each land having an entry edge at one side thereof over which the end of the implement may freely move into contact with the exposed surface disposed in a space between lands and an exit edge at its other side for camming said end out of said space onto the adjacent land, and (d) the construction being such that as the implement is moved along its guided path, its marking end oscillates toward and from the surface, producing the spaced marks thereon only in the spaces between lands, (e) the circular rows being formed as two angularly spaced sets, each set extending substantially 180° about a center and having dividing rims between rows which preclude drawing beneath same, the rims being staggered so that a line which cannot be drawn in one set may be drawn in the other set and the remaining 180° of the line may be drawn after rotating the support member 180°, whereby broken lines of all radii within the range of the rows may be drawn in complete circles, (f) the dividing rims of one set are staggered in radial positions substantially mid-way between those of the other set.

* * * * *